US009286868B2

(12) United States Patent
Fitzgerald

(10) Patent No.: US 9,286,868 B2
(45) Date of Patent: Mar. 15, 2016

(54) DECORATIVE DRUM PAD AND CYMBAL COVER

(71) Applicant: Paul L Fitzgerald, Redondo Beach, CA (US)

(72) Inventor: Paul L Fitzgerald, Redondo Beach, CA (US)

( * ) Notice: Subject to any disclaimer, the term of this patent is extended or adjusted under 35 U.S.C. 154(b) by 0 days.

(21) Appl. No.: 13/931,823

(22) Filed: Jun. 29, 2013

(65) Prior Publication Data

US 2015/0000503 A1 Jan. 1, 2015

(51) Int. Cl.
*G10D 13/02* (2006.01)
*G10G 7/00* (2006.01)

(52) U.S. Cl.
CPC ..... *G10G 7/00* (2013.01); *G10D 13/02* (2013.01); *G10D 13/027* (2013.01); *G10D 13/029* (2013.01)

(58) Field of Classification Search
CPC ... G10D 13/02; G10D 13/029; G10D 13/027; G10G 7/00
USPC ..... 84/411 R
See application file for complete search history.

(56) References Cited

U.S. PATENT DOCUMENTS 3,251,258 A * 5/1966 Parker ..... 84/453
4,037,509 A * 7/1977 Slomovits ..... 84/422.3
4,073,612 A * 2/1978 Nitta ..... 431/126
4,706,540 A * 11/1987 Donohoe ..... 84/414
4,979,422 A * 12/1990 Belli ..... 84/414
5,517,891 A * 5/1996 Sica ..... 84/453
6,063,992 A * 5/2000 Schwagerl ..... 84/411 P
6,649,817 B2 * 11/2003 Hartill ..... 84/267
7,030,304 B1 * 4/2006 Harris ..... 84/290
7,476,794 B2 * 1/2009 May, Jr. ..... 84/411 R
7,635,809 B2 * 12/2009 Higgs et al. ..... 84/327
2004/0139839 A1 * 7/2004 Chiang ..... 84/411 R
2007/0295188 A1 * 12/2007 Lu ..... 84/411 R
2013/0118338 A1 * 5/2013 Wallace et al. ..... 84/626
2014/0144309 A1 * 5/2014 Cawthorne ..... 84/411 R
2014/0238217 A1 * 8/2014 Squillante ..... 84/411 R

* cited by examiner

*Primary Examiner* — Robert W Horn
(74) *Attorney, Agent, or Firm* — Michael Ries

(57) ABSTRACT

A decorative drum pad and cymbal cover that includes a back plate with a back side and a top side, the back plate is secured in position by a cymbal or drum stand and a mounting, the mounting removably secures the back plate to the cymbal stand and an image holding area placed on the top side of the back plate. The decorative drum pad and cymbal cover also includes a protective cover placed on top of the image holding area, the protective cover protects the image holding area from a plurality of drumstick strikes from a user and an drum trigger that includes a back side and an electrical signal outlet jack, the electrical signal outlet jack is attached to the back side of the back plate with one or more fasteners and the electrical signal outlet jack is disposed on the back side of the drum trigger.

20 Claims, 6 Drawing Sheets

DECORATIVE DRUM PAD AND CYMBAL COVER

TECHNICAL FIELD & BACKGROUND

Musicians are known to be extremely creative and talented people. Many musicians, including drummers are always looking for creative designs for their musical equipment.

The present invention generally relates to a drum pad and cymbal cover. More specifically, the invention is a decorative drum pad and cymbal cover.

It is an object of the present invention to provide a decorative drum pad and cymbal cover to allow a user to customize a drum kit with one or more desired images such as one or more photographs, pieces of sheet music, drawings and lists placed over a drum pad or a cymbal.

It is an object of the present invention to provide a decorative drum pad and cymbal cover with a liquid crystal display or LCD display device to display one or more desired images such as one or more photographs or part of a video placed over a drum pad or a cymbal.

It is an object of the present invention to provide a decorative drum pad and cymbal cover that utilizes a musical instrument digital interface or MIDI or USB interface to display one or more desired images such as one or more photographs, pieces of sheet music, drawings and lists placed over a drum pad or a cymbal.

What is really needed is a decorative drum pad and cymbal cover to allow a user to customize a drum kit with one or more desired images such as one or more photographs, pieces of sheet music, drawings and lists placed over a drum pad or a cymbal that can have a LCD display device to display one or more desired images such as one or more photographs that are rotating or are part of a video placed over a drum pad or a cymbal that can utilize a MIDI or USB interface to display one or more desired images such as one or more photographs, pieces of sheet music, drawings and lists.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
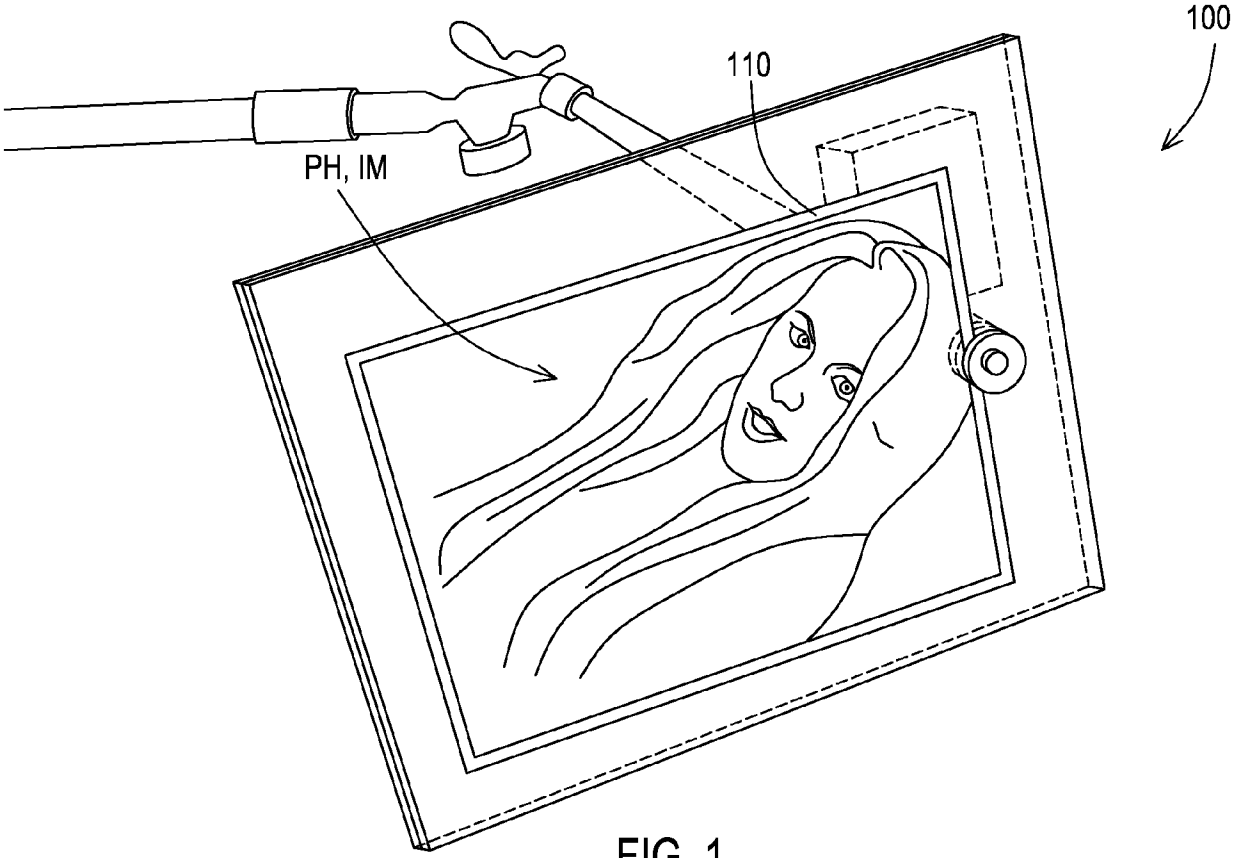
FIG. 1 illustrates a front environmental perspective view of a decorative drum pad and cymbal cover, in accordance with one embodiment of the present invention.

FIG. 1 illustrates a front environmental perspective view of a decorative drum pad and cymbal cover 100, in accordance with one embodiment of the present invention.

The decorative drum pad and cymbal cover 100 can include any suitable type of drum pad and cymbal cover with a MIDI or a USB interface (not shown), which is illustrated and described in subsequent figures. The decorative drum pad and cymbal cover 100 includes an image holding area 110. The image holding area 110 can removably secure an image IM such as a photograph, one or more pieces of sheet music, drawings, lists or any other suitable image. FIG. 1 illustrates a photograph PH of a fan of the user of the decorative drum pad and cymbal cover 100 such as an attractive blond girl but can be any suitable photograph. Additional details regarding the image holding area 110 are illustrated and described in subsequent figures.

Figure 2:
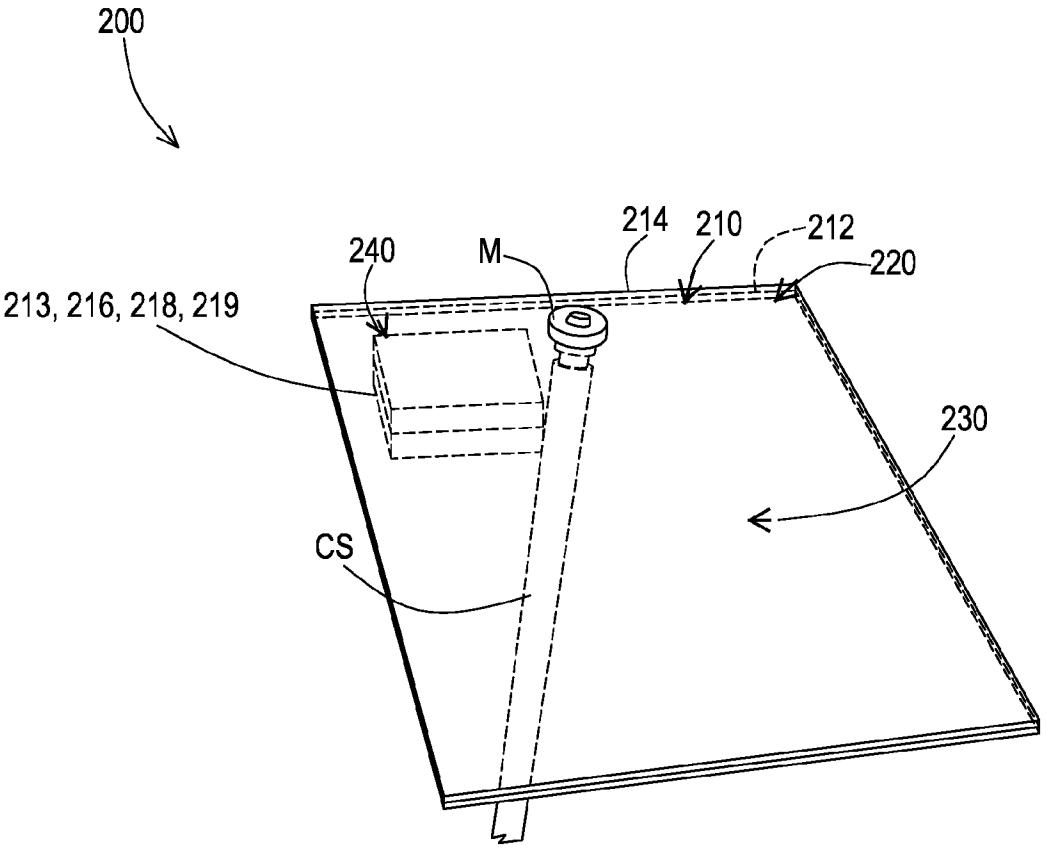
FIG. 2 illustrates a front perspective view of a decorative drum pad and cymbal cover, in accordance with one embodiment of the present invention.

FIG. 2 illustrates a front perspective view of a decorative drum pad and cymbal cover 200, in accordance with one embodiment of the present invention. The decorative drum pad and cymbal cover 200 illustrated in FIG. 2 is similar to the decorative drum pad and cymbal cover 100 illustrated in FIG. 1.

The decorative drum pad and cymbal cover 200 illustrated in FIG. 2 includes a back plate 210, an image holding area 220, a protective cover 230 and an electronics housing 240. The back plate 210 has a back side 212 and a top side 214 and is secured in position by a selected one of a cymbal stand CS and a drum stand DS and a mounting M, which removably secures the back plate 210 to the cymbal stand CS or the drum stand DS which can be adjustable or stationary. The back plate 210 can be made of a relatively light, transparent, weather-resistant thermoplastic or PLEXIGLAS®, metal, or other suitable material. The image holding area 220 is similar to the image holding area 110 illustrated and described in FIG. 1. The image holding area 220 is placed on the top side 214 of the back plate 210 and contains one or more photographs PH, pieces of sheet music (not shown), drawings (not shown) and lists (not shown). The protective cover 230 is placed on top of the image holding area 220 and protects the image holding area 220 from a plurality of drumstick strikes from a user, which is typically a drummer or any other suitable user. The protective cover 230 can be made of PLEXIGLAS®, clear rubber, clear vinyl or other suitable clear material depending on the strike needs of the user. The protective cover 230 is removable and replaceable and can be purchased separately from the decorative drum pad and cymbal cover 200. The electronics housing 240 is attached to the back side 212 of the back plate 210 with a fastener 213 selected from one of one or more rivets 216, one or more adhesives 218, one or more screws 219 or any other suitable one or more fasteners. Additional details regarding the electronics housing 240 are illustrated and described in subsequent FIGS. 3 and 4 and their description.

The decorative drum pad and cymbal cover 200 can optionally have an LCD screen for one or more digital images selectable by the user through either a USB or a flash type media (not shown). The LCD screen is protected by a solid PLEXIGLAS® type cover (not shown) and have a relatively softer vinyl cover affixed over that. The LCD screen can display a single image, rotating images or even moving video. The decorative drum pad and cymbal cover 200 may store sounds held in memory that are triggered when the cymbal is struck by hand or sticks. The decorative drum pad and cymbal cover 200 may also contain circuitry to allow MIDI output through means of standard MIDI data including but not limited to Note On, Note Off, MIDI Note Number and Velocity. Photo drum triggers with MIDI will be compatible with any suitable MIDI device. Two piezoelectric elements or sensors allow the strikes to be detected in different areas. Circuitry allows strike volume to trigger output to either of two output jacks allowing for a variance between iRide Cymbal & Belli sounds depending on strike volume and strike area.

Figure 3:
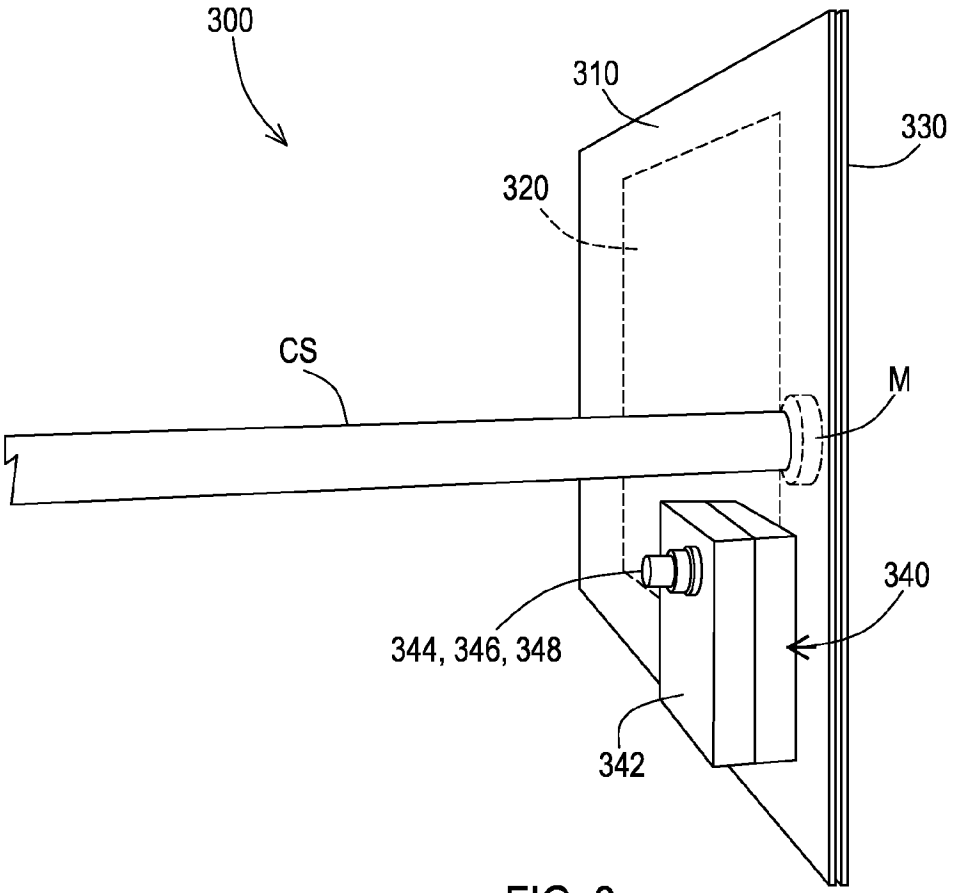
FIG. 3 illustrates a top perspective view of a decorative drum pad and cymbal cover, in accordance with one embodiment of the present invention.

FIG. 3 illustrates a top perspective view of a decorative drum pad and cymbal cover 300, in accordance with one embodiment of the present invention.

The decorative drum pad and cymbal cover 300, back plate 310, image holding area 320, protective cover 330 and electronics housing 340 illustrated in FIG. 3 is similar to the decorative drum pad and cymbal cover 200, back plate 210, image holding area 220, protective cover 230 and electronics housing 240 illustrated in FIG. 2.

The electronics housing 340 includes a back side 342 and an electrical signal outlet jack 344 which is a standard approximate ¼ inch guitar cable jack 346. The electrical signal outlet jack 344 is disposed on the back side 342 of the electronics housing 340. The electrical signal outlet jack 344 can also be a Radio Connection of America or RCA jack 348 or other suitable jack. The electronics housing 340 is approximately 3 inches in height by 2 inches in width, although the electronics housing 340 can be any other suitable dimensions.

Figure 4:
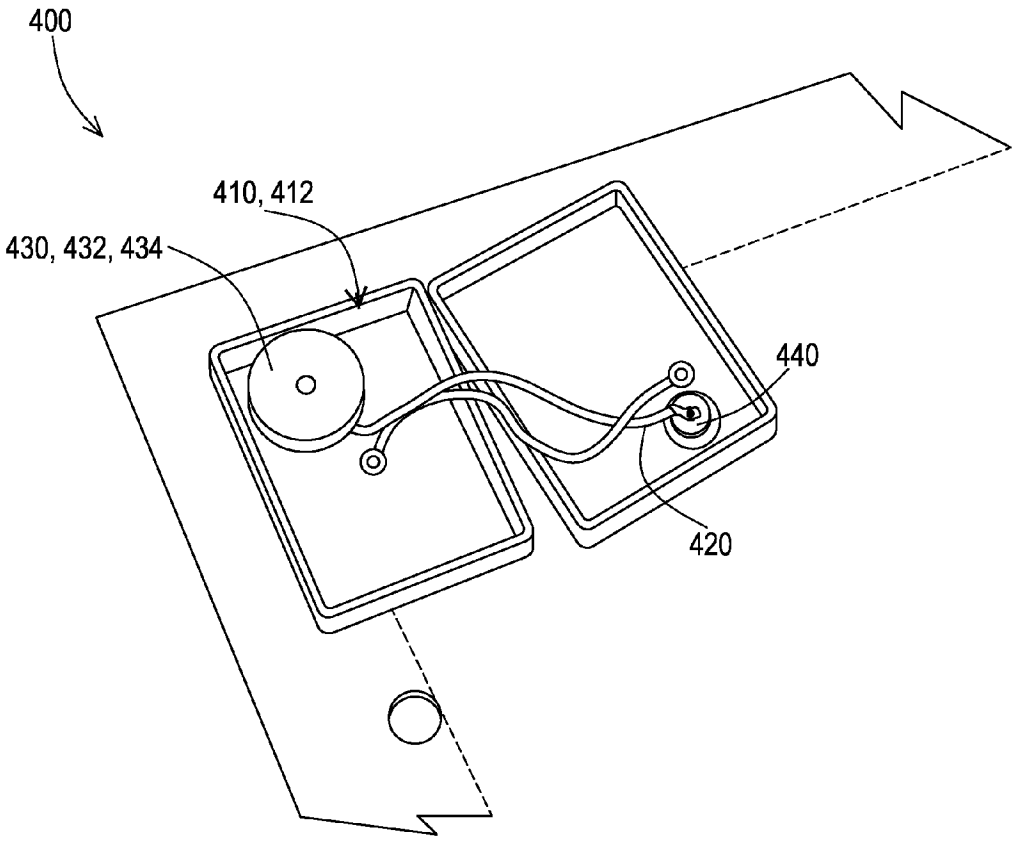
FIG. 4 illustrates a top perspective view of a drum trigger of a decorative drum pad and cymbal cover, in accordance with one embodiment of the present invention.

FIG. 4 illustrates a top perspective view of an electronics housing 410 of a decorative drum pad and cymbal cover 400, in accordance with one embodiment of the present invention. The electronics housing 410 illustrated and described in FIG. 4 is similar to the electronics housing 340 illustrated and described in FIG. 3. The electronic housing 410 illustrated and described in FIG. 4 is in an open position and illustrates an interior 412 of the electronics housing 410.

The electronics housing 410 includes a plurality of wires 420 and a piezoelectric element 430. The plurality of wires 420 extends from the piezoelectric element 430 to an electrical signal outlet jack 440. The electrical signal outlet jack 440 is similar to the electrical signal outlet jack 344 illustrated and described in FIG. 3. The piezoelectric element 430 is sound sensor piezoelectric element 432 or other microphone element 434 to detect impact by sound created by the user striking the decorative drum pad and cymbal cover 400. The electronics housing 410 can also house an electronic sample recording device (not shown) that plays back one or more audio samples in a preprogrammed EPROM.

Figure 5:
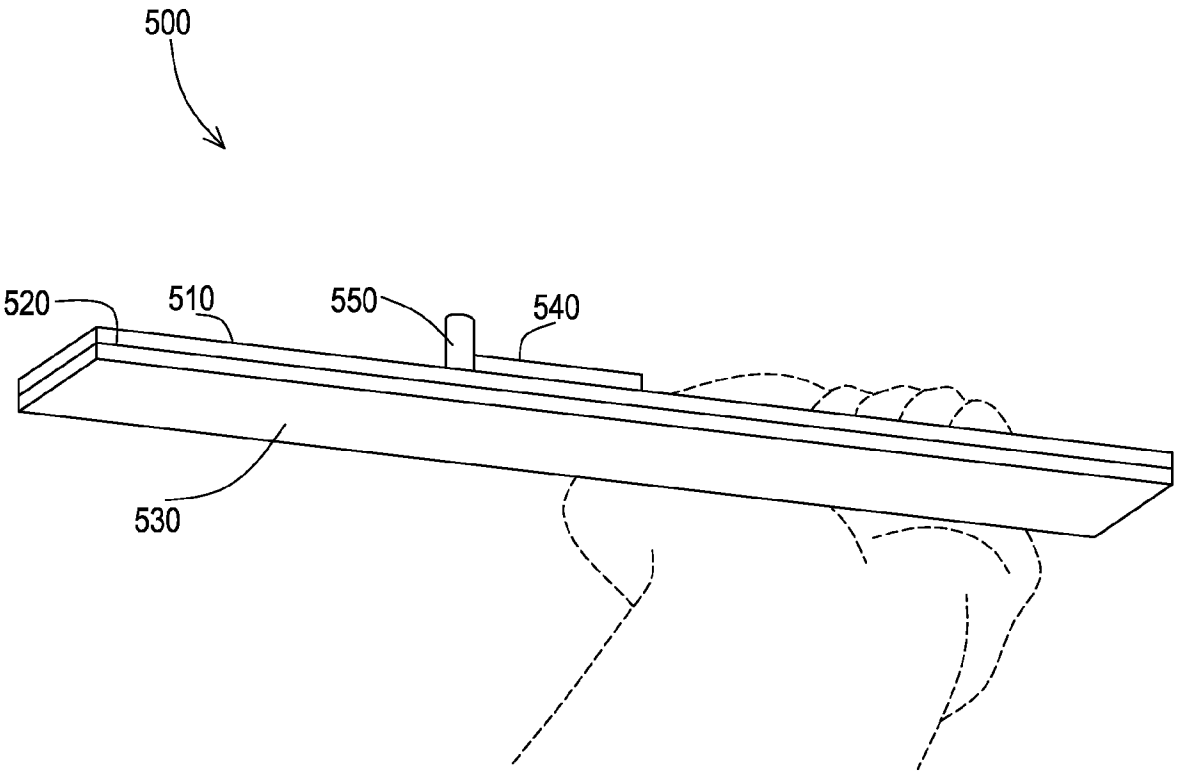
FIG. 5 illustrates a side view of a decorative drum pad and cymbal cover, in accordance with one embodiment of the present invention.

FIG. 5 illustrates a side view of a decorative drum pad and cymbal cover 500, in accordance with one embodiment of the present invention.

The decorative drum pad and cymbal cover 500, back plate 510, image holding area 520, protective cover 530, electronics housing 540 and electrical signal outlet jack 550 illustrated in FIG. 5 is similar to the decorative drum pad and cymbal cover 300, back plate 310, image holding area 320, protective cover 330, electronics housing 340 and electrical signal outlet jack 344 illustrated in FIG. 3.

Figure 6:
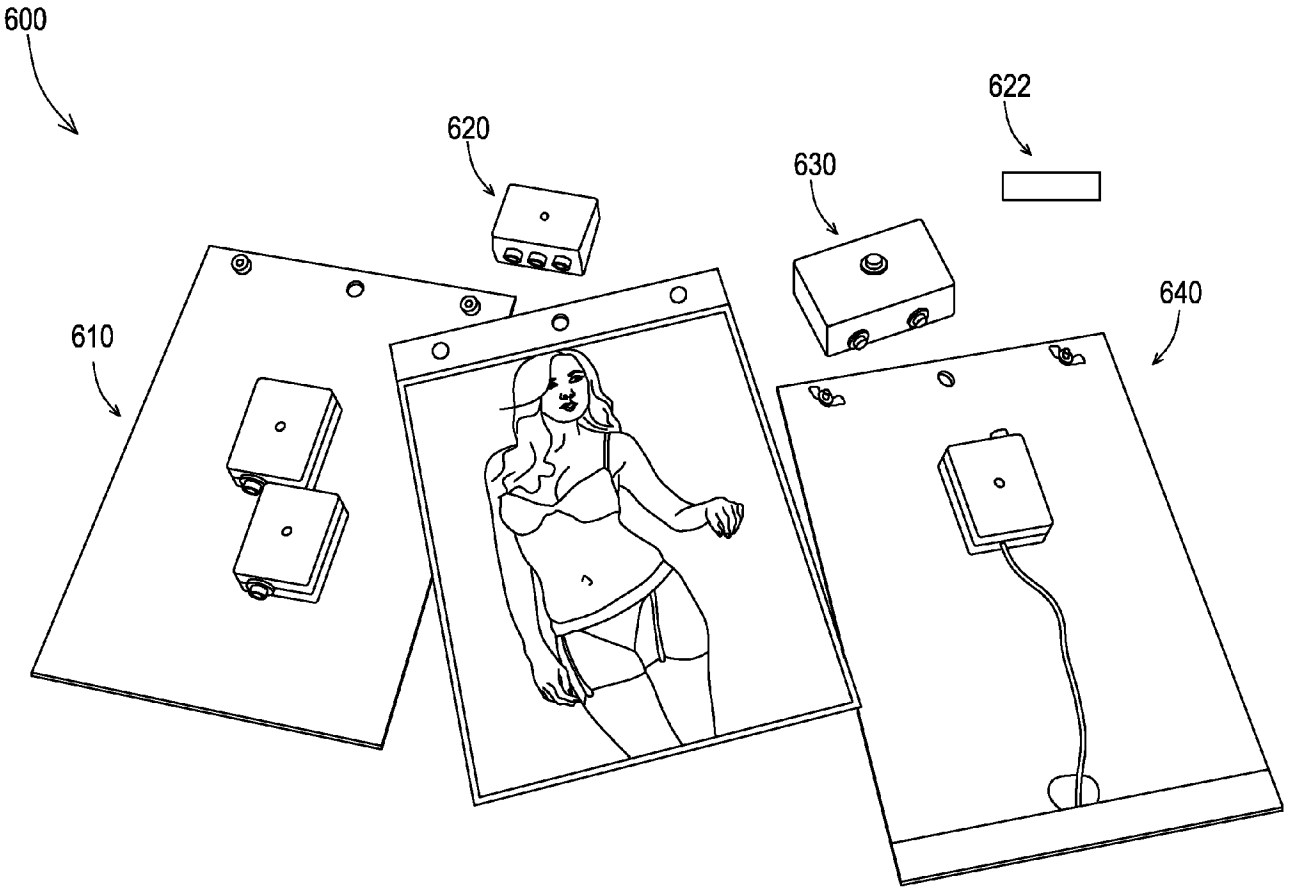
FIG. 6 illustrates a plurality of supplemental electrical components of a decorative drum pad and cymbal cover 600, in accordance with one embodiment of the present invention.

FIG. 6 illustrates a plurality of supplemental electrical components of a decorative drum pad and cymbal cover 600, in accordance with one embodiment of the present invention.

The supplemental electrical components can include a selected one of an isolation decorative drum pad and cymbal cover 610, a foot pedal cutoff device 620, a merging device 630 and a dual zone decorative drum pad and cymbal cover 640. The isolation decorative drum pad and cymbal cover 610 includes a pair of electronics housings 650 that are attached to the isolation decorative drum pad and cymbal cover 610. The pair of electronics housings 650 each transmits a signal to activate a pair of decorative drum pad and cymbal covers 610 when the isolation decorative drum pad and cymbal cover 610 is struck. The foot pedal cutoff device 620 transmits a signal received from an electronics housing 650 of a decorative drum pad and cymbal cover 600 to a foot pedal 622 to allow the foot pedal 622 to cutoff the decorative drum pad and cymbal cover 600. The merging device 630 combines a signal transmitted from an electronics housing 650 from each of two separate decorative drum pad and cymbal covers 600 to transmit a single signal to a foot pedal 622 without the electronics housing 650 from each of the two separate decorative drum pad and cymbal covers 600 to separately transmit a signal to the foot pedal 622. The dual zone decorative drum pad and cymbal cover 640 includes an electronics housing 650 and is self-grounding. The dual zone decorative drum pad and cymbal cover 640 produces a first sound when struck and can produce a second sound if struck with a force that exceeds a predetermined threshold force.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A decorative drum pad and cymbal cover, comprising:

a back plate with a back side and a top side, the back plate is secured in position by a selected one of a cymbal stand and a drum stand and a mounting, the mounting removably secures the back plate to said the selected one of a cymbal stand and a drum stand;

an image holding area placed on the top side of the back plate;

a protective cover placed on top of the image holding area, the protective cover protects the image holding area from a plurality of drumstick strikes from a user; and an electronics housing that includes a back side and an electrical signal outlet jack, the electrical signal outlet jack is attached to the back side of the back plate with one or more fasteners, the electrical signal outlet jack is disposed on the back side of the electronics housing.

2. The decorative drum pad and cymbal cover according to claim 1, wherein the selected one of a cymbal stand and a drum stand is a selected one of an adjustable stand and a stationary stand.

3. The decorative drum pad and cymbal cover according to claim 1, wherein the protective cover is removable and replaceable.

4. The decorative drum pad and cymbal cover according to claim 1, wherein the protective cover is purchased separately from the decorative drum pad and cymbal cover.

5. The decorative drum pad and cymbal cover according to claim 1, wherein the electrical signal outlet jack is a standard ¼ inch guitar cable jack.

6. The decorative drum pad and cymbal cover according to claim 1, wherein the electrical signal outlet jack is a RCA jack.

7. The decorative drum pad and cymbal cover according to claim 1, wherein the fastener is a selected one of one or more rivets, one or more adhesives and one or more screws.

8. The decorative drum pad and cymbal cover according to claim 1, wherein the electronics housing includes a plurality of wires and a piezoelectric element, the pair of wires extends from the piezoelectric element to the electrical signal outlet jack.

9. The decorative drum pad and cymbal cover according to claim 8, wherein the piezoelectric element is a sound sensor piezoelectric element to detect impact by sound created by the user striking the decorative drum pad and cymbal cover.

10. A decorative drum pad and cymbal cover, comprising:

a back plate with a back side and a top side, the back plate is secured in position by a selected one of a cymbal stand and a drum stand and a mounting, the mounting removably secures the back plate to the selected one of a cymbal stand and a drum stand;

an image holding area placed on the top side of the back plate;

a removable and replaceable protective cover placed on top of the image holding area, the protective cover protects the image holding area from a plurality of drumstick strikes from a user; and an electronics housing that includes a back side and an electrical signal outlet jack, the electrical signal outlet jack is attached to the back side of the back plate with one or more fasteners, the electrical signal outlet jack is disposed on the back side of the electronics housing, the electronics housing includes a plurality of wires and a piezoelectric element, the pair of wires extends from the piezoelectric element to the electrical signal outlet jack.

11. The decorative drum pad and cymbal cover according to claim 10, wherein the selected one of a cymbal stand and a drum stand is a selected one of an adjustable stand and a stationary stand.

12. The decorative drum pad and cymbal cover according to claim 10, wherein the decorative drum pad and cymbal cover has a crystal display or LCD display device.

13. The decorative drum pad and cymbal cover according to claim 10, wherein the protective cover is purchased separately from the decorative drum pad and cymbal cover.

14. The decorative drum pad and cymbal cover according to claim 10, wherein the electrical signal outlet jack is a standard ¼ inch guitar cable jack.

15. The decorative drum pad and cymbal cover according to claim 10, wherein the electrical signal outlet jack is a RCA jack.

16. The decorative drum pad and cymbal cover according to claim 10, wherein the fastener is a selected one of one or more rivets, one or more adhesives and one or more screws.

17. The decorative drum pad and cymbal cover according to claim 16, wherein the piezoelectric element is a sound sensor piezoelectric element to detect impact by sound created by the user striking the decorative drum pad and cymbal cover.

18. The decorative drum pad and cymbal cover according to claim 10, wherein the protective cover is made of a selected one of transparent, weather-resistant thermoplastic, clear rubber and clear vinyl.

19. The decorative drum pad and cymbal cover according to claim 10, wherein the decorative drum pad and cymbal cover include a selected one of an isolation decorative drum pad and cymbal cover, a foot pedal cutoff device, a merging device and a dual zone decorative drum pad and cymbal cover.

20. The decorative drum pad and cymbal cover according to claim 10, wherein the electronics housing is 3 inches in height by 2 inches in width.

* * * * *